United States Patent [19]

Reed et al.

[11] 3,954,529

[45] May 4, 1976

[54] FLARE COMPOSITION WITH CARBOXY FUNCTIONAL BINDER AND POLYALKYLENE OXIDE PHOSPHATE ESTER, AND METHOD

[75] Inventors: Russell Reed, Ridgecrest, Calif.; Graham Shaw, Garland; Robert Meyer, North Ogden, both of Utah

[73] Assignee: Thiokol Corporation, Newtown, Pa.

[22] Filed: June 19, 1975

[21] Appl. No.: 588,142

[52] U.S. Cl. ..... 149/19.6; 149/19.5; 149/19.9; 149/19.91; 149/19.92; 149/20; 149/116

[51] Int. Cl.[2] ..... C06B 31/02; C06B 33/02

[58] Field of Search ..... 149/19.5, 19.6, 19.9, 149/19.91, 19.92, 20, 116

[56] References Cited

UNITED STATES PATENTS

| | | | |
|---|---|---|---|
| 3,147,161 | 9/1964 | Abere et al. | 149/19.5 |
| 3,461,066 | 8/1969 | Fay et al. | 149/19.91 |
| 3,462,325 | 8/1969 | Arikawa et al. | 149/19.91 X |
| 3,605,624 | 9/1971 | Dinsdale et al. | 149/116 X |
| 3,723,206 | 3/1973 | Dinsdale et al. | 149/19.5 |
| 3,728,172 | 4/1973 | Dillehay et al. | 149/19.5 |

*Primary Examiner*—Edward A. Miller

[57] ABSTRACT

A flare composition is passivated to prevent gas generation during curing at elevated temperatures by incorporating therein as a passivating agent a small amount of a polyalkylene oxide phosphate ester. The additive also serves to increase the pot life of the composition.

6 Claims, No Drawings

FLARE COMPOSITION WITH CARBOXY FUNCTIONAL BINDER AND POLYALKYLENE OXIDE PHOSPHATE ESTER, AND METHOD

This invention relates to a novel flare composition adapted to be used in illuninating flares and target markers and to a method of making the same.

Flare compositions commonly comprise magnesium powder, a finely divided inorganic oxidizer and an organic polymeric binder. A representative flare of this type is disclosed in Dinsdale et al. U.S. Pat. No. 3,605,624. As disclosed in the Dinsdale et al. patent, an illuminating flare may be made by mixing the particulate magnesium metal and an inorganic oxidizer with a liquid carboxy-functional polymer, e.g., a carboxylterminated polyester, and a curing agent therefor, e.g., a liquid polyepoxide, to form a plastic mass, introducing the mixture into a suitable flare casing and heating the charged casing to an elevated temperature for a period of hours to cure the liquid polymer to form a polymeric binder for the magnesium and oxidizer particles.

In order to achieve a long burning rate it is necessary to use a relatively high proportion, say at least 10% by weight of the curable mixture, of the liquid binder components. However, it has been found that when carboxy-functional liquid polymers are used at such high concentrations as binder precursors in such compositions, a certain amount of gas is generated during the elevated temperature cure of the composition. This gas generation produces swollen and porous flare grains having inferior burning properties. By using sodium nitrate as the oxidizer and special passivation of the surfaces of the magnesium powder, it has been found possible to obtain non-gassing compositions having relatively long processing times, but this procedure greatly increases the cost of the flare composition.

It is accordingly an object of the present invention to provide a flare composition of the general type referred to above having a reduced tendency to generate gases during curing. It is another object of the invention to provide a flare composition of this type containing a passivating agent which inhibits gas formation during curing of the composition. It is still another object of the invention to provide a passivating agent which when incorporated in such a flare composition extends the "pot life" of the composition, i.e., the period during which it can be effectively cast prior to curing. Other objects of the invention will be in part obvious and in part pointed out hereafter.

The objects and advantages of the present invention can best be achieved by incorporating into a flare composition of the general type described above, prior to curing, a small amount of a passivating agent which is a polyalkylene oxide phosphoric acid ester. Polyalkylene oxide phosphate esters are known per se. One commercially available phosphate ester passivating agent that has been found satisfactory is that sold under the trade designation GAFAC RS410. This material is believed to be a mixture of organic mono- and di-esters of phosphoric acid with the organic radicals being polyethylene oxide groups having relatively long chain aliphatic hydrophobic groups on the ends thereof. Another phosphate ester mixture sold under the designation RS-610 can also be used. The passivating agent may be used to the extent of say 0.1 to 5% by weight of the composition, preferably 0.5 to 2.0%.

It has been further found that incorporation of a polyalkylene oxide phosphoric acid ester in the curable composition not only inhibits gas formation but also extends the pot life of the composition. The utility of the phosphoric acid ester additive in extending the pot life of the compositions is not limited to compositions containing 10% or more of the carboxy-functional binder; it may be used with advantage over the entire range of proportions of binder known to be useful in the manufacture of flare compositions.

In general, any of the known flare compositions utilizing carboxy-functional polymers as binders can be passivated in accordance with the present invention. The preferred binders are of the type disclosed in U.S. Pat. No. 3,605,624. As disclosed in that patent, the carboxy-functional polymer may be a saturated carboxyl-terminated liquid polyester sold under the trade designation WITCO Formrez F-17-80. Curing of the carboxylterminated polyester may be achieved by using, for example, a trifunctional epoxy resin which is the reaction product of glycerol and epichlorhydrin (EPON 812) or a triglycidyl ether of trimethylol propane (ERLA 0510). Other carboxy-functional liquid curable prepolymers that may be employed are carboxyl-terminated polybutadienes such as disclosed in Berenbaum patent 3,235,589 or butadiene or isoprene copolymers with acrylic acid such as disclosed in Lowrey et al. patent 3,563,966. More generally, any of the carboxy-functional liquid prepolymers known to be useful as binders in flare compositions can be used in the present compositions.

The amount of the carboxy-functional polymer may vary, for example, from about 5 to 30% of the total weight of the composition and the amount of curing agent may vary from about 0.6 to 5% by weight of the composition. If a long burning flame is desired, the preferred amount of binder is about 10% to 20% of the composition and the preferred amount of epoxide curing agent is from about 1.5% to 3% by weight. If a shorter burning time is desired or acceptable, lower amounts of binder may be used. In such cases no gas-generating problem is encountered but the phosphoric acid ester additive still provides an important advantage in that it increases the pot life of the composition.

Magnesium powder of the type usually employed in flares can be used in the present compositions. A typical magnesium powder comprises chipped and balled granules having an average particle size of 50 to 200 mesh. The quantity of magnesium powder used may vary from 5% or lower to 65% of more with the preferred range being 11% to 55% by weight of the composition.

The particulate inorganic oxidizer used in the composition is preferably sodium nitrate. However, other inorganic oxidizers known to be useful in flare compositions can be used, e.g., strontium nitrate, strontium perchlorate, barium nitrate, barium perchlorate, ammonium nitrate and potassium perchlorate. The oxidizer may vary from 20% or less to 75% or more by weight of the composition with the preferred amount of oxidizer being about 30% to 67% by weight. It is usually desirable to employ a blend of oxidizer particles of different sizes. For example, if sodium nitrate is used, a useful blend is one part of 5-micron sodium nitrate particles to 5 parts of 150-micron particles.

In addition to the ingredients referred to above, it is usually desirable to include a curing catalyst in the composition to promote curing of the organic binder.

Suitable catalysts are the so-called iron drying catalysts, e.g., ferric oleate or linoleate, ferric aceto-acetonate or ferric octoate. The amount of curing catalyst may be, for example 0.01 to 0.5% by weight of the composition with the preferred quantity being 0.05 to 2% by weight.

Mixing of the ingredients of the composition can be effected in any suitable mixer, preferably in a dry inert atmosphere to avoid moisture pick-up. Mixing can be effected in a period of say 20 to 30 minutes at a temperature that is desirably slightly above ambient temperature to improve the viscosity of the mixture. After mixing the mixture is charged to a suitable flare container and then cured for a period of say 1 to 4 days at a temperature of 100° to 160°F.

The burning rate of the cured composition depends largely upon the magnesium and binder levels used. In general, these proportions are so selected as to yield compositions having burning rates within the range 0.5 to 4.0 inches per minute.

In order to point out more fully the nature of the present invention, there are given below in Table I several specific formulations embodying the present invention together with the curing conditions for those compositions and the burning rates of the cured compositions.

Table I

| Component | Quantity in Parts by Weight A | B | C |
|---|---|---|---|
| Polyester Polymer (WITCO Formrez F-17-80) | 18.8 | 17.1 | 12.85 |
| Epoxide Curing Agent (EPON 812) | 3.1 | 2.8 | 2.10 |
| Curing Catalyst (Ferric Octoate) | 0.1 | 0.1 | 0.05 |
| Magnesium Granules | 11.0 | 20.0 | 50.0 |
| Sodium Nitrate | 67.0 | 60.0 | 35.0 |
| Passivating Agent (GAFAC RS-410) | 1.0 | 1.0 | 1.0 |
| Curing Time (hours) | 64 | 64 | 64 |
| Curing Temperature (°F.) | 135 | 135 | 135 |
| Burning Rate (in./min.) | 0.83 | 1.0 | 3.0 |

All of compositions A, B and C cured to give essentially pore-free elastomeric grains of excellent mechanical properties.

It is, of course, to be understood that the foregoing description is intended to be illustrative only and that numerous changes can be made in the ingredients, proportions and conditions set forth without departing from the spirit of the invention as defined in the appended claims.

We claim:

1. In a flare composition of the type which comprises magnesium powder, a finely divided inorganic oxidizer, and a cured carboxy-functional polymeric binder, the improvement which comprises a small amount of a polyalkylene oxide phosphoric acid ester incorporated in said composition as a passivating agent.

2. A flare composition according to claim 1 wherein the polyalkylene oxide phosphoric acid ester is a polyethylene oxide phosphoric acid ester.

3. A flare composition according to claim 1 containing from 0.1 to 5% by weight of said polyalkylene oxide phosphoric acid ester passivating agent.

4. A flare composition according to claim 1 containing from 0.5 to 2% by weight of said polyalkylene oxide phosphoric acid ester passivating agent.

5. A flare composition comprising 5% to 65% by weight of magnesium granules, 20% to 75% by weight of sodium nitrate and 5% to 35% by weight of a cured carboxy-functional polymeric binder and 0.1 to 5% by weight of a passivating agent which is a polyalkylene oxide phosphoric acid ester.

6. The method of making a flare composition which comprises preparing a mixture of 5% to 30% by weight of a carboxyfunctional liquid polymer, 0.6% to 5% by weight of a polyepoxide curing agent for said polymer, 0.01 to 5% of a curing catalyst, 5 to 65% of magnesium granules, 20% to 75% of finely divided inorganic oxidizer, and 0.1 to 5% of a passivating agent which is a polyalkylene oxide phosphoric acid ester and curing said mixture at a temperature of 80° to 200°F. for a period of 16 to 96 hours to form said flare composition.

* * * * *